US006049681A

United States Patent [19]

Shiozawa et al.

[11] Patent Number: 6,049,681

[45] Date of Patent: Apr. 11, 2000

[54] IMAGE FORMING APPARATUS

[75] Inventors: Motohide Shiozawa, Mishima; Yuichiro Toyohara, Fujisawa, both of Japan

[73] Assignee: Canon Kabushiki Kaisha, Tokyo, Japan

[21] Appl. No.: 09/106,360

[22] Filed: Jun. 29, 1998

[30] Foreign Application Priority Data

Jul. 1, 1997 [JP] Japan ..... 9-176157
Jun. 16, 1998 [JP] Japan ..... 10-168352

[51] Int. Cl.[7] ..... G03G 15/00

[52] U.S. Cl. ..... 399/46; 399/50; 399/66; 399/101; 399/302

[58] Field of Search ..... 399/34, 46, 48, 399/49, 50, 66, 71, 99, 101, 127, 128, 234, 235, 302, 314, 343, 345, 308, 129, 310

[56] References Cited

U.S. PATENT DOCUMENTS

| | | | |
|---|---|---|---|
| 5,512,986 | 4/1996 | Toyomura et al. | 399/308 X |
| 5,671,462 | 9/1997 | Toyohara et al. | 399/33 |
| 5,732,310 | 3/1998 | Hiroshima et al. | 399/101 |
| 5,754,920 | 5/1998 | Tanaka et al. | 399/49 |
| 5,809,373 | 9/1998 | Yoda et al. | 399/101 |

FOREIGN PATENT DOCUMENTS 9-050198 2/1997 Japan .

*Primary Examiner*—Sophia S. Chen
*Attorney, Agent, or Firm*—Fitzpatrick, Cella, Harper & Scinto

[57] ABSTRACT

An image forming apparatus has an image bearing member, an image forming unit adapted to form a toner image on the image bearing member and having a first charge member for charging the image bearing member with the same polarity as normal polarity on toner, an intermediate transfer member, a voltage apply means for applying voltage to the intermediate transfer member to electrostatically transfer the toner image formed on the image bearing member by the image forming unit onto the intermediate transfer member at a first transfer station, a second charge member for charging residual toner remaining on the intermediate transfer member with polarity opposite to the normal polarity of the toner on the image bearing member, after the toner image on the intermediate transfer member is electrostatically transferred onto a transfer material at a second transfer station, and a controller for variably controlling voltage applied to the first charge member, and the voltage application generates an electric field for transferring the residual toner on the intermediate transfer member charged by the second charge member onto the image bearing member and at the same time transferring a next toner image on the image bearing member onto the intermediate transfer member, at the first transfer station, and, the control unit controls voltage applied to the voltage application in accordance with the voltage applied to the first charge member, when the electric field is generated at the first transfer station.

46 Claims, 6 Drawing Sheets

IMAGE FORMING APPARATUS

BACKGROUND OF THE INVENTION

1. Field of the Invention

The present invention relates to an image forming apparatus in which toner images formed on an image bearing member are transferred onto an intermediate transfer member, and then the toner images on the intermediate transfer member are transferred onto a transfer material.

2. Related Background Art

In four full-color image forming apparatuses using an intermediate transfer member, firstly-transferring process for transferring a toner image formed on an image bearing member (for example, a photosensitive drum) onto an intermediate transfer member (for example, an intermediate transfer drum or an intermediate transfer belt) is repeated for four color toners to successively transfer the four color toner images onto the intermediate transfer member in a superimposed fashion. Then, secondary-transferring process for collectively transferring the four color toner image on the intermediate transfer member onto a transfer material such as a paper sheet is effected to obtain a four full-color image.

After the secondary-transferring process, toner which was not secondary-transferred to the transfer material (referred to as "secondary-transferring residual toner" hereinafter) is remaining on the surface of the intermediate transfer member by several percentage (%). If the secondary-transferring residual toner leaves as it is, during next image formation, the secondary-transferring residual toner will be transferred onto a next transfer material to result in poor image, or will be scattered within the image forming apparatus to contaminate the transfer material. Thus, in the image forming apparatuses using the intermediate transfer member, there is a problem how to remove or clean the secondary-transferring residual toner remaining on the intermediate transfer member.

To solve this problem, for example, as disclosed in U.S. Pat. No. 5,732,310, there has been proposed a technique in which the secondary-transferring residual toner on the intermediate transfer member is charged to polarity (positive) opposite to normal polarity (negative) of the toner on the photosensitive drum by using a charge roller, and, at a firstly transfer station, the secondary-transferring residual toner is reversely-transferred from the intermediate transfer member onto the photosensitive drum to collect the residual toner by utilizing difference in potential (electric field) between surface potential (firstly-transfer bias) of the intermediate transfer member and surface potential of the photosensitive drum. In this case, the reverse transferring process for transferring the secondary-transferring residual toner from the intermediate transfer member onto the photosensitive drum and the firstly-transferring process for transferring the toner image from the photosensitive drum onto the intermediate transfer member are effected simultaneously to improve through-put of the image formation.

However, in the above-mentioned image forming apparatus, there arose the following problem.

In the reverse transferring process for transferring the secondary-transferring residual toner from the intermediate transfer member onto the photosensitive drum, the secondary-transferring residual toner is shifted by the difference in potential (electric field) between the surface potential (firstly-transfer bias) of the intermediate transfer member and the surface potential of the photosensitive drum. For example, when the surface of the photosensitive drum is charged to −550 V by a first charger and the firstly-transfer bias to be applied to the intermediate transfer member is set to +200 V, due to the difference in potential (electric field) of 750V therebetween, the toner having reverse polarity (positive polarity) is collected onto the photosensitive drum.

By the way, in full-color image formation requiring high density stability, in order to cope with time-lapse degradation of the photosensitive drum, there is provided a density detect means for detecting density of the toner image on the photosensitive drum, and automatic control is effected on the basis of the detected result to optimize the density of the toner image. As methods for controlling the density, there have been proposed a method for controlling a toner fog condition by changing the charged potential of the photosensitive drum and a method for controlling the optimum density by changing developing bias.

For example, when the surface potential of the photosensitive drum is set to −650 V, due to the potential control for the photosensitive drum, the difference in potential between the surface potential and the firstly-transfer bias becomes 850 V. By the way, if the difference in potential becomes greater than 800 V, at a firstly transfer nip between the photosensitive drum and the intermediate transfer member, Paschen discharge is generated, so that the secondary-transferring residual toner which was charged positively by the charge roller is charged negatively (minus) again, thereby causing poor cleaning (in which the residual toner is not collected onto the photosensitive drum). If such poor cleaning is caused, the secondary-transferring residual toner is accumulated on the intermediate transfer member, so that the residual toner is adhered to a succeeding (next) transfer material or is scattered within the image forming apparatus, thereby causing poor image.

SUMMARY OF THE INVENTION

An object of the present invention is to provide an image forming apparatus which can prevent poor transferring of residual toner from an intermediate transfer member to an image bearing member, and poor transferring of a next toner image from the image bearing member to the intermediate transfer member.

The other objects and features of the present invention will be apparent from the following detailed explanation referring to the accompanying drawings.

DETAILED DESCRIPTION OF THE PREFERRED EMBODIMENTS

The present invention will now be explained in connection with embodiments thereof with reference to the accompanying drawings.

<First Embodiment>

Figure 1:
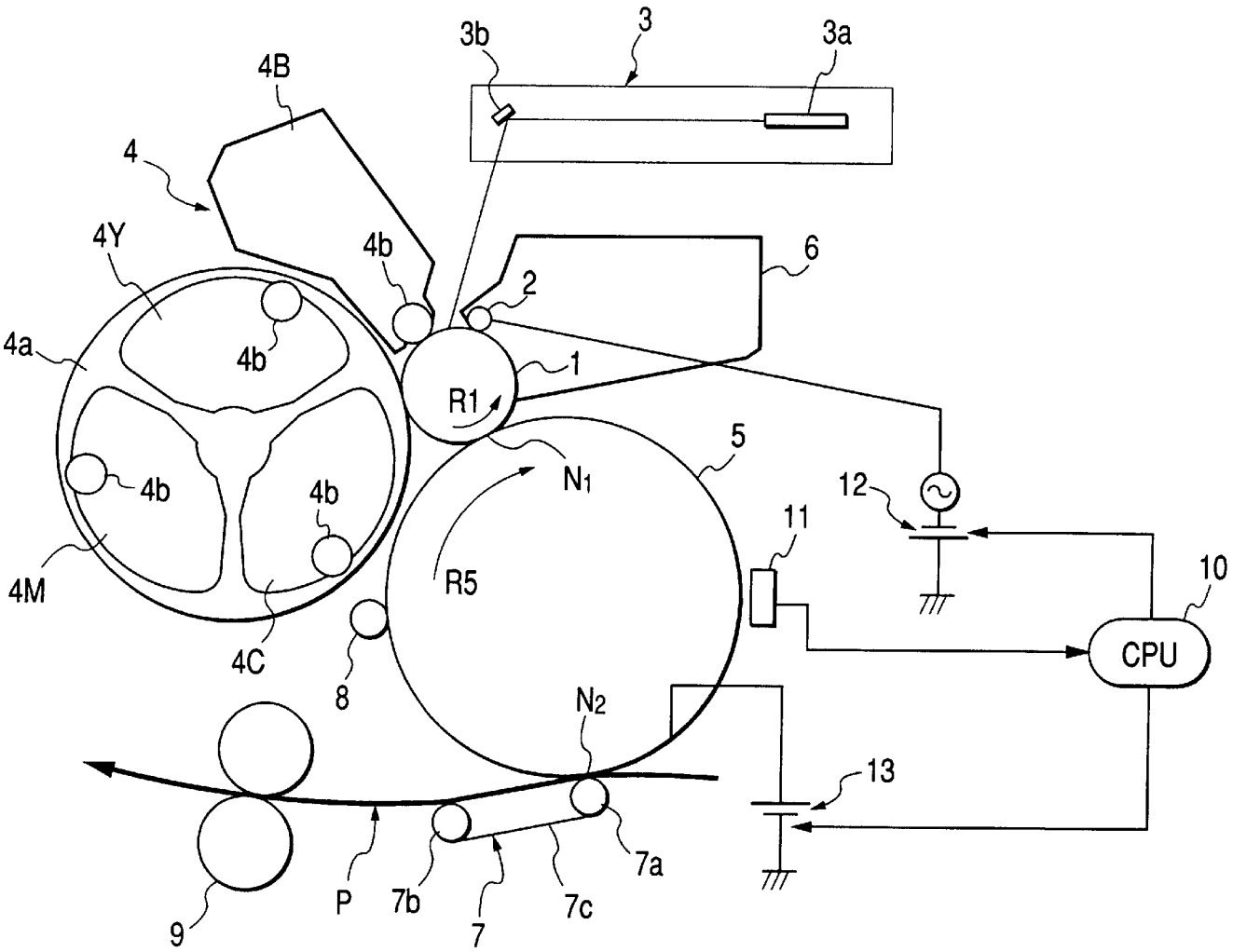
FIGS. 1 and 2 are schematic elevational sectional views of an image forming apparatus according to a first embodiment of the present invention.
Figure 2:
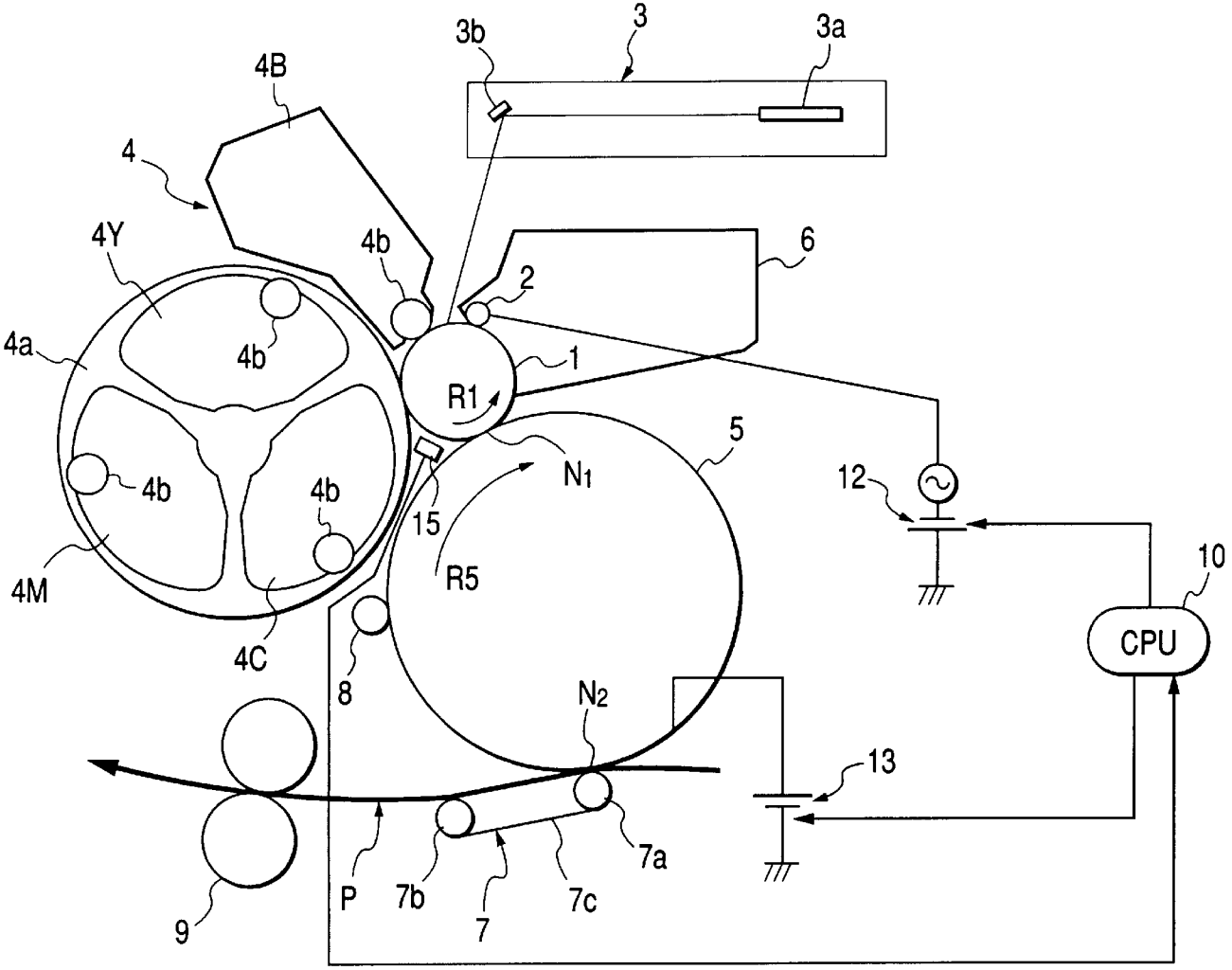

FIGS. 1 and 2 are schematic elevational sectional views of an image forming apparatus according to the present invention, in which a four full-color laser beam printer using an intermediate transfer drum as an intermediate transfer member is embodied.

The laser beam printer (referred to as "image forming apparatus" hereinafter) shown in FIGS. 1 and 2 includes a drum-shaped electrophotographic photosensitive member (referred to as "photosensitive drum" hereinafter) 1 as an image bearing member. The photosensitive drum 1 is rotated by a drive means (not shown) in a direction shown by the arrow R1.

Around the photosensitive drum 1, along a rotational direction thereof and substantially in order, there is disposed an image forming means comprised of a first charger 2, an exposure device 3 and a developing means 4. That is to say, there are disposed the first charger (first charge member) 2 for uniformly charging a surface of the photosensitive drum 1 with predetermined potential having negative polarity, the exposure device 3 for exposing the surface of the photosensitive drum 1 on the basis of image information to form an electrostatic latent image, and the developing means 4 developing the electrostatic latent image with toner to form a toner image.

Further, there are provided an intermediate transfer drum (intermediate transfer member) 5 onto which the toner images on the photosensitive drum 1 are firstly-transferred, and a cleaning device (cleaning means) 6 for removing firstly-transferring residual toner remaining on the surface of the photosensitive drum 1 after firstly-transferring. Below the intermediate transfer drum 5, there is provided a secondary-transferring device 7 for secondary-transferring the toner images on the intermediate transfer drum 5 onto a transfer material P such as a paper sheet. At a downstream side of the secondary-transferring device 7 in a rotational direction (shown by the arrow R5) of the intermediate transfer drum 5, there is provided a cleaning bias applying roller (second charge member) 8 for applying charges to secondary-transferring residual toner remaining a surface of the intermediate transfer drum 5 after secondary-transferring. Further, at a downstream side of the secondary-transferring device 7 in a conveying direction for the transfer material P, there is provided a fixing device 9 for fixing the toner images to a surface of the transfer material P.

A density sensor 11 is disposed in a confronting relation to the surface of the intermediate transfer drum 5 and is connected to a control device (CPU) 10 as a control means. A first charge power source 12 for applying voltage to the first charger 2 and a firstly-transferring bias power source 13 for applying voltage to a metal core of the intermediate transfer drum 5 are connected to the control device 10.

The exposure device 3 includes a laser generating device 3*a* and a reflection mirror 3*b* and serves to form the electrostatic latent image corresponding to the image information by illuminating a laser beam, corresponding to the image information onto the surface of the photosensitive drum 1 charged by the first charger 2 to remove the charges from the illuminated area.

The developing device 4 includes a fixedly mounted black toner developing device 4B, and color toner developing devices mounted on a rotatable rotary 4*a*, i.e., a yellow toner developing device 4Y, a magenta toner developing device 4M and a cyan toner developing device 4C. The color toner developing devices are used for development of the electrostatic latent images on the photosensitive drum 1 and are selectively brought to a position to be opposed to the photosensitive drum 1. Each of the developing devices 4B, 4Y, 4M and 4C has a developing sleeve (developing member) 4*b*. By applying developing bias from a developing bias apply power source (not shown) to the developing sleeve 4*b*, the electrostatic latent image on the photosensitive drum 1 is developed with toner.

The intermediate transfer member 5 is constituted by a metal core (aluminium cylinder) as a conductive body, an elastic layer made of rubber and coated on the metal core, and a coat layer which is coated on the elastic layer and onto which the toner image is transferred. When the firstly-transferring is effected, the predetermined voltage is applied from the firstly-transferring bias power source 13 to the metal core of the intermediate transfer member 5.

The secondary-transferring device 7 comprises a secondary-transferring roller 7*a*, a drive roller 7*b*, a transfer belt 7*c* extending between the rollers 7*a*, 7*b*, and a secondary-transferring bias power source (not shown) for applying secondary-transfer bias to the secondary-transferring roller 7*a*, so that, by applying predetermined secondary-transfer bias from the secondary-transferring bias power source to the secondary-transferring roller 7*a*, the toner images on the intermediate transfer member 5 are secondary-transferred onto the surface of the transfer material P electrostatically.

Next, an operation of the image forming apparatus will be explained.

The photosensitive drum 1 rotated in the direction R1 by the drive means (not shown) is substantially uniformly charged by the first charger 2 with about −550 V (surface potential). In this case, voltage obtained by overlapping DC voltage (−570 V) with AC voltage (Vpp: 2 KV, frequency= 1150 Hz) is applied to the first charger 2 from the first charge power source. Then, the exposure is effected by the exposure device 3 in response to the image information, thereby removing the charges from the exposed area to form the electrostatic latent image. The surface of the photosensitive drum 1 after the exposure includes dark portions (non-exposure portions) having potential of −550 V and bright portions (exposed portions) having potential of −180 V.

Then, the developing bias of −350 V is applied to the developing sleeve 4*b* of the developing device now used for development, so that negative toner having negative charging polarity is adhered to the bright portions (−180 V) of the surface of the photosensitive drum 1, thereby developing (visualizing) as the toner image. A firstly transfer nip (first transfer station) $N_1$ is formed between the surface of the photosensitive drum 1 and the surface of the intermediate transfer drum 5, and the drums are rotated in the same direction at substantially the same speed at the firstly transfer nip $N_1$.

Firstly transfer bias $V_1$ of +200 V is applied from the firstly transfer bias power source 13 to the metal core of the intermediate transfer drum 5, so that the toner image on the photosensitive drum 1 is firstly-transferred onto the intermediate transfer drum 5 at the firstly transfer nip $N_1$ due to potential difference (electric field) of 750 V between the photosensitive drum 1 and the intermediate transfer drum 5. Such firstly transferring process is successively repeated regarding yellow (Y) color, magenta (M) color, cyan (C) color and black (B) color to form a color image obtained by superimposing four color toner images on the intermediate transfer member 5.

The transfer belt 7*c* can be engaged by and disengaged from the intermediate transfer drum 5 by means of a mechanism (not shown). During the secondary-transferring, the transfer belt 7*c* is engaged by the intermediate transfer drum 5 to form a secondary transfer nip $N_2$ therebetween, and predetermined secondary transfer bias $V_2$ is applied to the secondary transfer roller 7*a*. In this condition, when the transfer material P is being passed through the secondary transfer nip (second transfer station) $N_2$, the four color toner images on the intermediate transfer drum 5 are secondary-transferred onto the transfer material P collectively. The transfer material P on which the non-fixed toner images were born is sent to the fixing device 9, where the toner images are fused and mixed by heat and pressure to be fixed to the transfer material. In this way, the full-color image is formed.

Next, the process in which the next toner image on the photosensitive drum 1 is firstly-transferred onto the intermediate transfer drum 5 at the same time when the secondary-transferring residual toner (residual toner) on the intermediate transfer drum 5 is transferred onto the photosensitive drum 1 will be explained.

Figure 5:
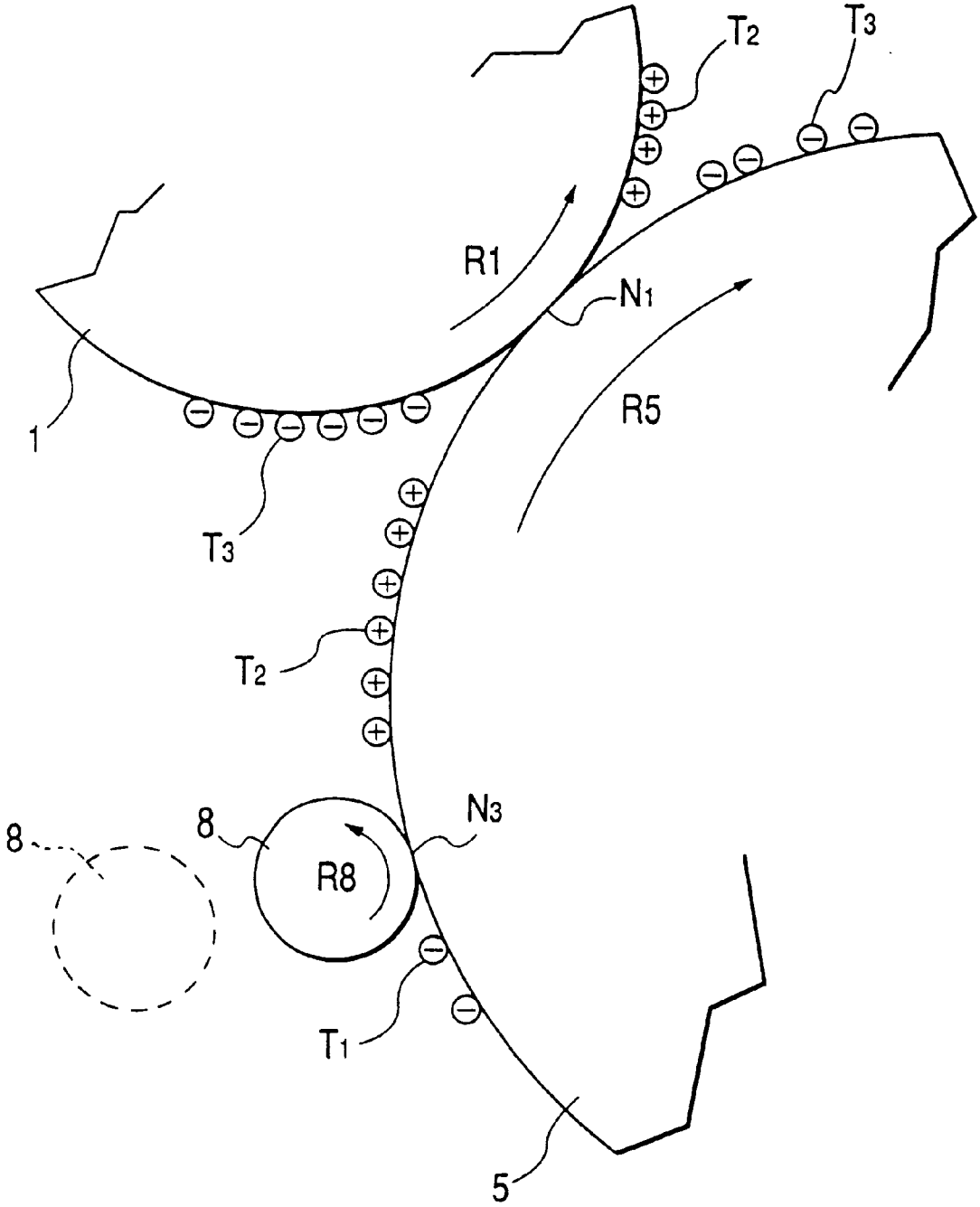
FIG. 5 is a schematic view showing a transferring process for transferring residual toner from an intermediate transfer member to an image bearing member to effect a firstly-transferring process simultaneously with the former transferring process.

FIG. 5 is a schematic view showing the toner collecting process and the firstly-transferring process effected simultaneously with the toner collecting process. The cleaning bias apply roller 8 can be engaged by and disengaged from (as shown by dotted lines) the intermediate transfer drum 5 and is supported in parallel with the intermediate transfer drum 5. When the cleaning bias apply roller 8 is engaged by the intermediate transfer drum 5, a nip $N_3$ is formed therebetween. Further, the cleaning bias apply roller 8 is rotatingly driven in a direction shown by the arrow R8 as the intermediate transfer drum 5 is rotated in the direction R5.

After the toner images are secondary-transferred from the intermediate transfer drum 5 to the transfer material P, the secondary-transferring residual toner $T_1$ (residual toner) which was not transferred to the transfer material P is remaining on the intermediate transfer drum 5. When voltage obtained by overlapping DC voltage of +1000 V with AC voltage of 2 kHz and 3 kVpp is applied to the cleaning bias apply roller 8, the secondary-transferring residual toner $T_1$ passing through the nip $N_3$ is charged with polarity (positive polarity) opposite to normal polarity of the toner on the photosensitive drum 1. When the oppositely charged secondary-transferring residual toner $T_2$ is being passed through the firstly transfer nip $N_1$, it is transferred onto the photosensitive drum 1 by the potential difference (electric field) between the photosensitive drum 1 and the intermediate transfer drum 5. In this case, at the same time, the next toner image ($T_3$) is firstly-transferred from the photosensitve drum 1 to the intermediate transfer drum 5 at the firstly transfer nip $N_1$. As mentioned above, the potentials of the photosensitive drum 1 and the intermediate transfer drum 5 are to −550 V and +200 V, respectively and thus, the potential difference becomes 750 V. Incidentally, in FIG. 5, a symbol $T_3$ denotes toner particles firstly-transferred from the surface of the photosensitive drum 1 to the intermediate transfer drum 5 at the firstly transfer nip $N_1$ due to the potential difference of 750 V.

In density control according to the illustrated embodiment, a predetermined test pattern image for toner density detection is formed on the photosensitive drum 1 and density of the test pattern image firstly-transferred to the intermediate transfer member 5 is detected by the density sensor (first density detect means) 11, and the voltage and developing bias to be applied to the first charger 2 are changed to obtain the optimum density of the toner image.

For example, explaining control for preventing fog of the image (toner), light reflected from the toner image is measured by the density sensor 11, and an optimum value of the developing bias for obtaining the optimum target density is calculated by the control device 10. Then, an optimum value of the voltage to be applied to the first charger 2 not to cause the fog of the image regarding the determined developing bias is calculated, and command is emitted to the first charge power source 12 to emit the desired voltage. In the first embodiment, when the target value of the charge potential of the photosensitive drum 1 is changed, for example, from −550 V to −650 V by the potential control, by emitting the command from the control device 10 so that DC voltage to be applied from the firstly transfer bias power source 13 to the first charger 2 is changed from −570 V to −670 V and the firstly transfer bias is changed from +200 V to +100 V, the potential difference of 750 V required for collecting the secondary-transferring residual toner adhered to the intermediate transfer drum 5 onto the photosensitive drum 1 at the firstly transfer nip $N_1$.

Figure 6:
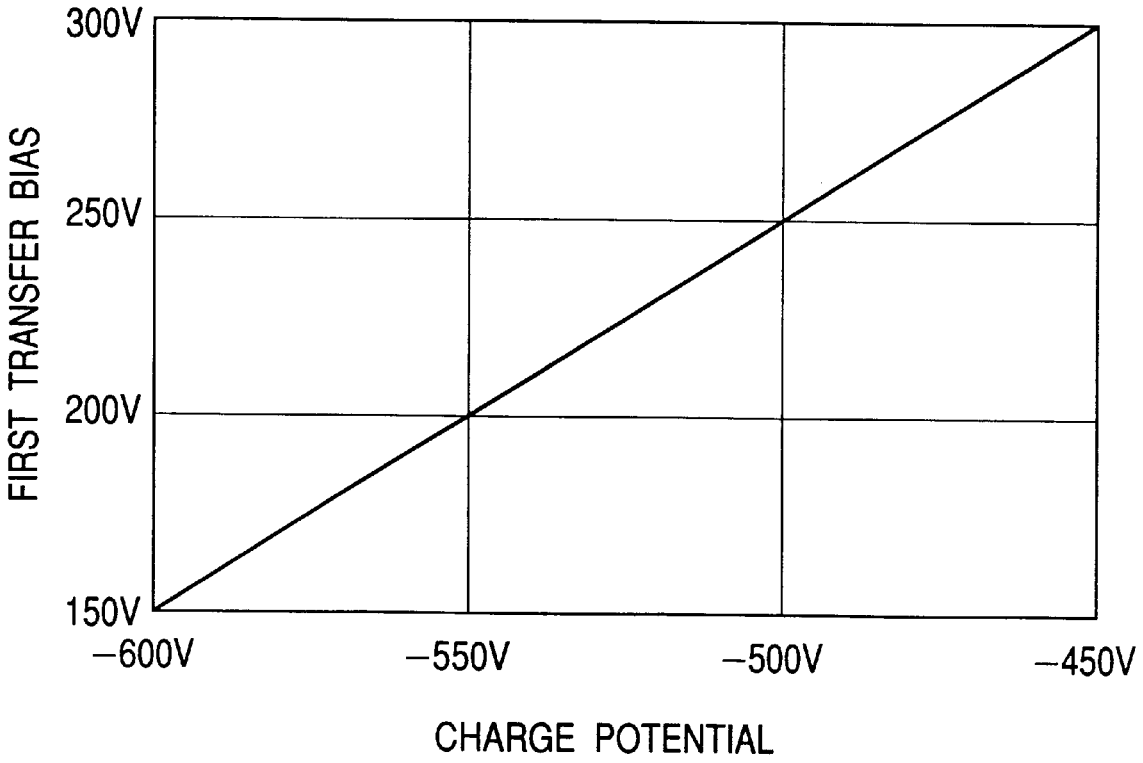
FIG. 6 is a view showing a relation between charge potential of the image bearing member and firstly transferring bias, which permit reversely-transferring of the residual toner from the intermediate transfer member to the image bearing member and the firstly-transferring simultaneously.

FIG. 6 shows a relation between the charge potential of the photosensitive drum and the firstly transfer bias (first transfer bias). In this relation, since the potential difference between the photosensitive drum 1 and the intermediate transfer drum 5 is kept substantially constant (750 V in the first embodiment), discharge is not generate at the firstly transfer nip $N_1$, and the secondary-transferring residual toner on the intermediate transfer drum 5 is reversely-transferred onto the photosensitive drum 1 positively, and, at the same time, the toner image is firstly-transferred from the photosensitive drum 1 to the intermediate transfer drum 5 effectively.

In the first embodiment, by assuming (on the basis of investigation of the Inventors) that a relation between the charge potential of the surface of the photosensitive drum 1 and the DC voltage of the voltage (obtained by overlapping DC voltage with AC voltage) to be applied from the first charge power source 13 to the first charger 2 is substantially constant, the firstly transfer bias is controlled by the control device 10 in accordance with the voltage to be applied to the first charger 2.

In the above explanation, while an example that, when the density control is effected, the density of the toner on the intermediate transfer drum 5 is detected by the density sensor 11 was explained, as shown in FIG. 2, toner density of the predetermined test pattern image formed on the photosensitive drum 1 may be detected by a density sensor (second density detect means) 15 connected to the control device 10 and density control may be effected as mentioned above on the basis of a detected result. In this case, since the firstly transferring process is not performed before the toner density is detected, the toner density which is not influenced by the transferring can be detected.

According to the illustrated embodiment, at the firstly transfer nip $N_1$, the transferring process for transferring the secondary-transferring residual toner from the intermediate transfer drum 5 to the photosensitive drum 1 and the firstly transferring process for transferring the next toner image from the photosensitive drum 1 to the intermediate transfer drum 5 can be effected simultaneously, to thereby prevent formation of poor image due to poor cleaning and improving through-put of image formation.

<Second Embodiment>

In the first embodiment, while an example that the firstly transfer bias is controlled in accordance with the voltage to be applied to the first charger 2 was explained, it was found that a relation between the voltage to be applied to the first charger 2 and the charge potential of the surface of the photosensitive drum 1 may be changed due to time-lapse degradation of the photosensitive drum 1, to thereby cause poor image.

Thus, an object of a second embodiment of the present invention is to prevent the formation of the poor image and to achieve higher accurate control.

Now, the second embodiment will be explained with reference to FIGS. 3 and 4. Incidentally, explanation of the same elements as those in the first embodiment will be omitted.

In the second embodiment, a potential sensor (detect means) is used to effect toner density control.

Figure 3:
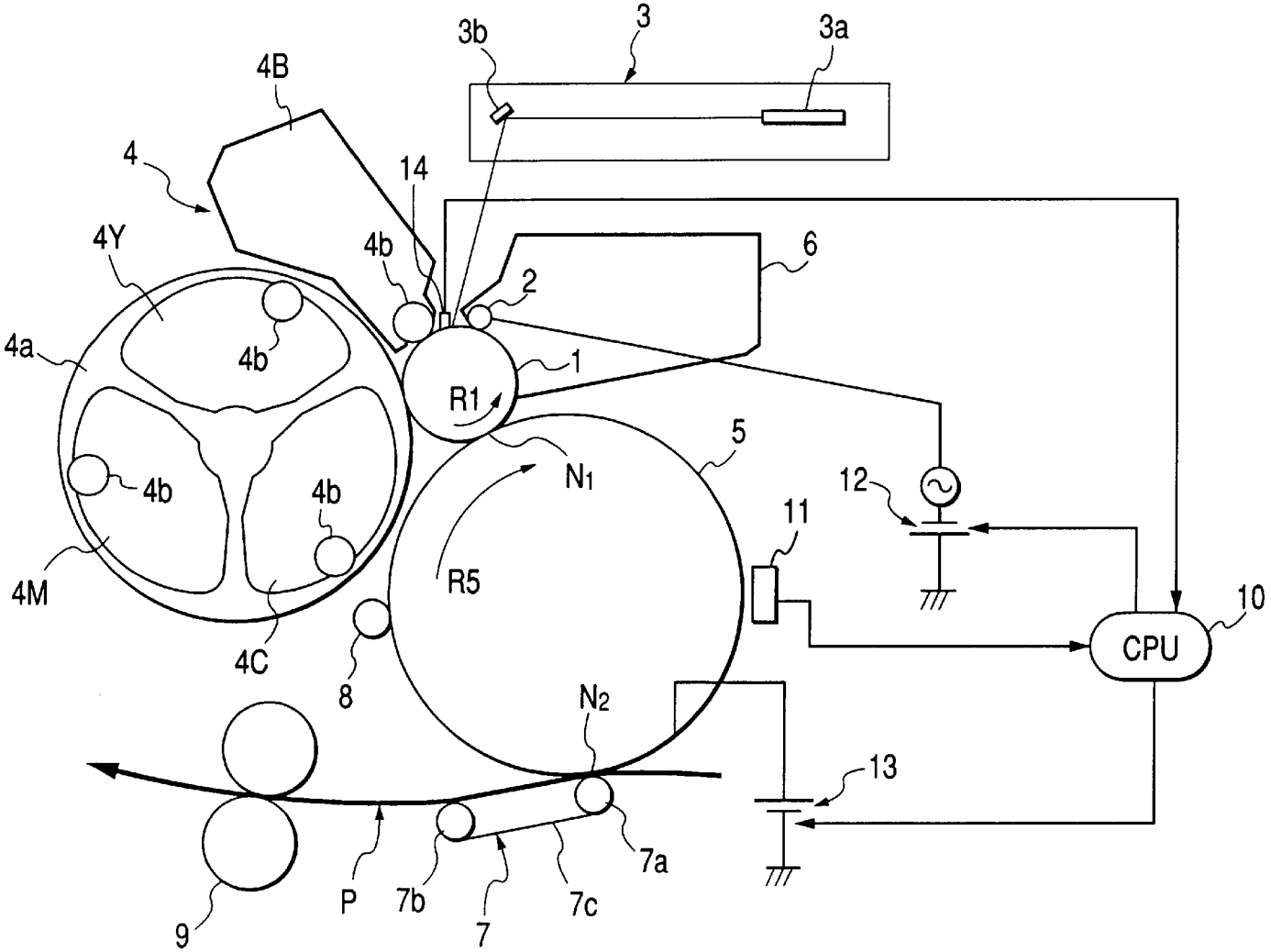
FIGS. 3 and 4 are schematic elevational sectional views of an image forming apparatus according to a second embodiment of the present invention.
Figure 4:
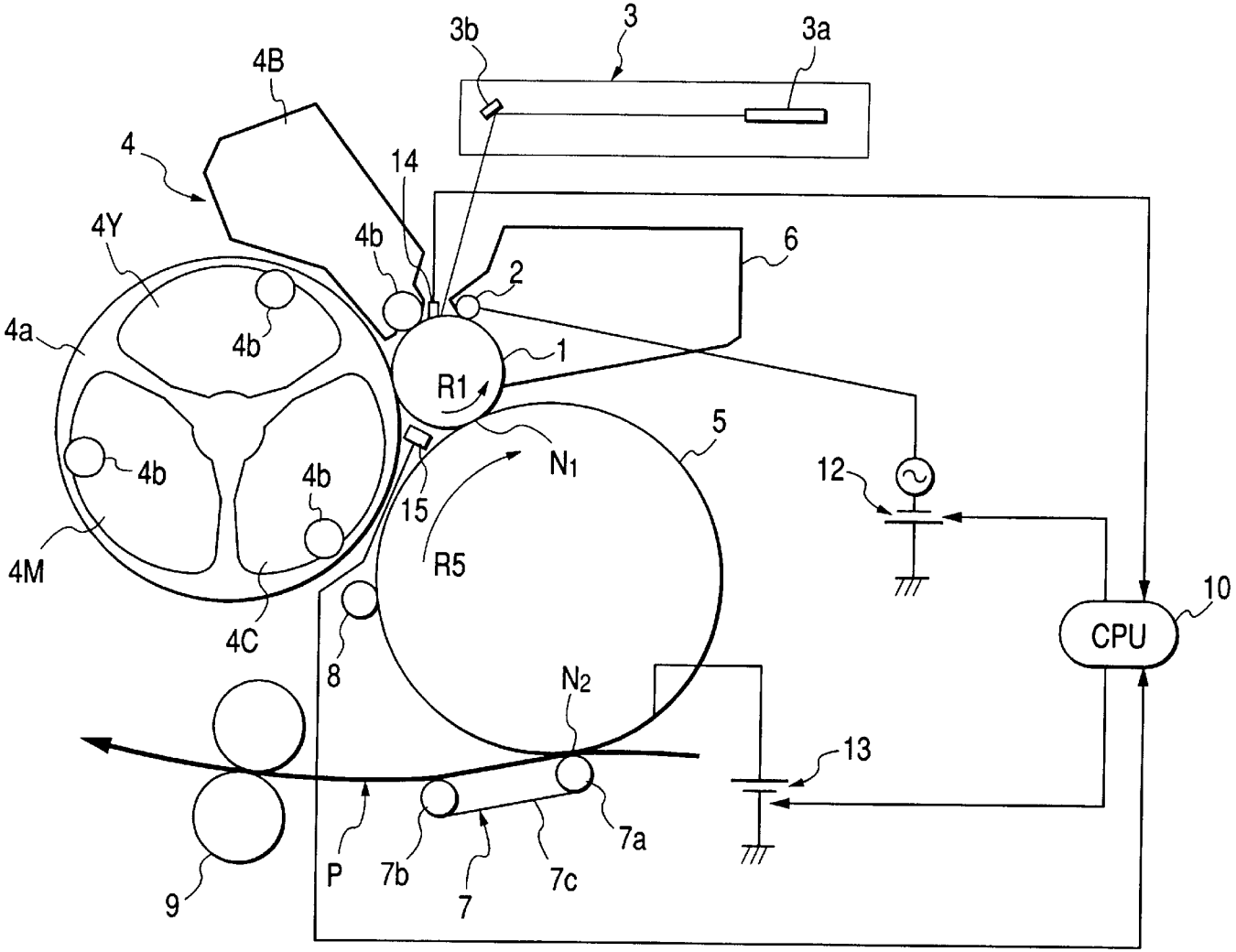

As shown in FIGS. 3 and 4, a potential sensor 14 is disposed at downstream of the first charger 2 for the photosensitive drum 1 and at upstream of the exposure position. The charge potential of the surface of the photosensitive drum 1 is detected by the potential sensor 14, based on which the firstly transfer bias is changed to obtain an image having optimum density.

In the second embodiment, the firstly transfer bias is changed so that a difference between the potential detected by the potential sensor 14 and the potential of the firstly transfer bias always becomes 750 V. With this arrangement, since the potential difference between the photosensitive drum 1 and the firstly transfer bias is kept substantially constant, the secondary-transferring residual toner on the intermediate transfer member 5 can be reversely transferred onto the photosensitive drum 1 positively.

As is in the first embodiment, in the second embodiment, as shown in FIGS. 3 and 4, the toner density control can be effected by detecting the density of the toner by using the density sensor 11 or the density sensor 15.

As mentioned above, in the first and second embodiments, while an example that the potential difference between the charge potential of the surface of the photosensitive drum 1 and the firstly transfer bias is kept substantially constant was explained, so long as the same effect as the present invention can be achieved, the potential difference may not be constant. Further, while an example that the intermediate transfer drum 5 is used as the intermediate transfer member was explained, in place of this, even when an intermediate transfer belt is used, the same effect can be achieved.

In the image forming apparatuses shown in FIGS. 1 to 4, while the roller of contact charging type was used as the first charger 2, in place of this, a corona charger may be used.

Further, while an example that the cleaning bias apply roller 8 is of contact charging type was explained, a non-contact charging type such as a corona charger may be used.

An example that the firstly transfer bias is applied to the metal core of the intermediate transfer drum 5 was explained. However, as mentioned above, when the intermediate transfer belt is used as the intermediate transfer member, by applying the first transfer bias to a roller, a blade or a corona charger from a back surface of a firstly transfer nip of the intermediate transfer belt, the firstly transfer electric field may be formed.

While an example that the belt transfer system is used as the secondary transfer device was explained, even when a corona transfer system or a roller transfer system is used, the same effect can be achieved; and while an example that the negative toner is used was explained, positive toner may be used.

What is claimed is:

1. An image forming apparatus comprising: an image bearing member;

image forming means for forming a toner image on said image bearing member and having a first charge member to charge said image bearing member;

an intermediate transfer member;

voltage apply means for applying a voltage to said intermediate transfer member to electrostatically transfer the toner image formed on said image bearing member by said image forming means onto said intermediate transfer member at a transfer position;

a second charge member for charging residual toner remaining on said intermediate transfer member with polarity opposite to normal polarity of the toner on said image bearing member, after the toner image on said intermediate transfer member is electrostatically transferred onto a transfer material; and control means for variably controlling a voltage applied to said first charge member;

wherein at the same time as transferring of a next toner image on said image bearing member onto said intermediate transfer member at said transfer position, said voltage apply means generates an electric field for transferring the residual toner on said intermediate transfer member charged by said second charge member onto said image bearing member, and said control means controls voltage applied to said intermediate transfer member by said voltage apply means in accordance with the voltage applied to said first charge member, when said electric field is generated at said transfer position.

2. An image forming apparatus according to claim 1, wherein, even when the voltage applied to said first charge member is changed, said control means controls the voltage applied to said intermediate transfer member by said voltage apply means so that potential difference between the voltage applied to said first charge member and the voltage applied to said voltage apply means is not substantially changed.

3. An image forming apparatus according to claim 1, wherein said first charge member charges said image bearing member with a same polarity as said normal polarity of the toner.

4. An image forming apparatus according to claim 3, wherein voltage obtained by overlapping DC voltage with AC voltage is applied to said first charge member.

5. An image forming apparatus according to claim 4, wherein said control means variably controls the AC voltage applied to said first charge member.

6. An image forming apparatus according to claim 1, 2 or 3, further comprising a first density detecting means for detecting density of the toner image on said intermediate transfer member, after the toner image is transferred from said image bearing member to said intermediate transfer member by said voltage apply means and before the toner image is transferred from said intermediate transfer member to the transfer material, and wherein said control means controls the voltage applied to said first charge member on the basis of a detected result from said first density detecting means.

7. An image forming apparatus according to claim 6, wherein voltage obtained by overlapping DC voltage with AC voltage is applied to said first charge member.

8. An image forming apparatus according to claim 7, wherein said control means variably controls the DC voltage applied to said first charge member on the basis of a detected result from said first density detecting means.

9. An image forming apparatus according to claim 7, wherein said voltage apply means applies a voltage of a polarity opposite to said normal polarity to a side opposite to a side onto which the toner image is transferred, of said intermediate transfer member.

10. An image forming apparatus according to claim 6, wherein said image forming means includes an exposure device for forming an electrostatic latent image by exposing said image bearing member charged by said first charge member, and a developing device for developing the electrostatic latent image on said image bearing member.

11. An image forming apparatus according to claim 10, wherein said control means controls voltage applied to said developing device in accordance with the detected result from said first density detecting means.

12. An image forming apparatus according to claim 6, wherein said image bearing member is capable of bearing plural color toner images to be successively transferred onto said intermediate transfer member in a superimposed fashion at said transfer position by said voltage apply means, and the plural color toner images on said intermediate transfer member are transferred onto the transfer material.

13. An image forming apparatus according to claim 1, 2 or 3 further comprising a density detecting means for detecting density of the toner image on said image bearing member, after the toner image is formed on said image bearing member by said image forming means and before the toner image on said image bearing member is transferred onto said intermediate transfer member, and wherein said control means controls the voltage applied to said first charge member on the basis of a detected result from said density detecting means.

14. An image forming apparatus according to claim 13, wherein voltage obtained by overlapping DC voltage with AC voltage is applied to said first charge member.

15. An image forming apparatus according to claim 14, wherein said control means variably controls the DC voltage applied to said first charge member on the basis of a detected result from said density detecting means.

16. An image forming apparatus according to claim 14, wherein said voltage apply means applies a voltage of a polarity opposite to said normal polarity to a side opposite to a side onto which the toner image is transferred, of said intermediate transfer member.

17. An image forming apparatus according to claim 13, wherein said image forming means includes an exposure device for forming an electrostatic latent image by exposing said image bearing member charged by said first charge member, and a developing device for developing the electrostatic latent image on said image bearing member.

18. An image forming apparatus according to claim 17, wherein said control means controls voltage applied to said developing device in accordance with the detected result from said density detecting means.

19. An image forming apparatus according to claim 13, wherein said image bearing member is capable of bearing plural color toner images to be successively transferred onto said intermediate transfer member in a superimposed fashion by said voltage apply means at said transfer position, and the plural color toner images on said intermediate transfer member are transferred onto the transfer material.

20. An image forming apparatus according to claim 1, wherein said first charge member has a roller.

21. An image forming apparatus according to claim 1, wherein said second charge member can engage with and disengage from said intermediate transfer member, and engages with said intermediate transfer member when the residual toner is charged.

22. An image forming apparatus according to claim 21, wherein said second charge member has a roller.

23. An image forming apparatus according to claims 1 or 4, wherein said voltage apply means applies a voltage of a polarity opposite to said normal polarity to a side opposite to a side onto which the toner image is transferred, of said intermediate transfer member.

24. An image forming apparatus comprising:

an image bearing member;

image forming means for forming a toner image on said image bearing member and having a first charge member to charge said image bearing member;

an intermediate transfer member;

voltage apply means for applying a voltage to said intermediate transfer member to electrostatically transfer the toner image formed on said image bearing member by said image forming means onto said intermediate transfer member at a transfer position;

a second charge member for charging residual toner remaining on said intermediate transfer member with polarity opposite to normal polarity of the toner on said image bearing member, after the toner image on said intermediate transfer member is electrostatically transferred onto a transfer material;

control means for variably controlling voltage applied to said first charge member; and detecting means for detecting charge potential of a surface of said image bearing member, after said image bearing member is charged by said first charge member;

wherein at the same time as transferring of a next toner image on said image bearing member onto said intermediate transfer member, at said transfer position, an electric field for transferring the residual toner on said intermediate transfer member charged by said second charge member onto said image bearing member is generated, and said control means controls voltage applied to said intermediate transfer member by said voltage apply means in accordance with the charge potential detected by said detecting means, when said electric field is generated at said transfer position.

25. An image forming apparatus according to claim 24, wherein even when the voltage applied to said first charge member is changed, said control means controls the voltage applied to said intermediate transfer member by said voltage apply means so that potential difference between the voltage applied to said first charge member and the voltage applied to said voltage apply means is not substantially changed.

26. An image forming apparatus according to claim 24, wherein said first charge member charges said image bearing member with a same polarity as said normal polarity of the toner.

27. An image forming apparatus according to claim 26, wherein voltage obtained by overlapping DC voltage with AC voltage is applied to said first charge member.

28. An image forming apparatus according to claim 27, wherein said control means variably controls the AC voltage applied to said first charge member.

29. An image forming apparatus according to claim 24 or 25, further comprising a first density detecting means for detecting density of the toner image on said intermediate transfer member, after the toner image is transferred from said image bearing member to said intermediate transfer member by said voltage apply means and before the toner image is transferred from said intermediate transfer member to the transfer material, and wherein said control means controls the voltage applied to said first charge member on the basis of a detected result from said first density detecting means.

30. An image forming apparatus according to claim 29, wherein voltage obtained by overlapping DC voltage with AC voltage is applied to said first charge member.

31. An image forming apparatus according to claim 30, wherein said control means variably controls the DC voltage applied to said first charge member on the basis of a detected result from said first density detecting means.

32. An image forming apparatus according to claim 30, wherein said voltage apply means applies a voltage of a polarity opposite to said normal polarity to a side opposite to a side onto which the toner image is transferred, of said intermediate transfer member.

33. An image forming apparatus according to claim 29, wherein said image forming means includes an exposure device for forming an electrostatic latent image by exposing said image bearing member charged by said first charge member, and a developing device for developing the electrostatic latent image on said image bearing member.

34. An image forming apparatus according to claim 33, wherein said control means controls voltage applied to said developing device in accordance with the detected result from said first density detecting means.

35. An image forming apparatus according to claim 29, wherein said image bearing member is capable of bearing plural color toner images to be successively transferred onto said intermediate transfer member in a superimposed fashion at said transfer position by said voltage apply means, and the plural color toner images on said intermediate transfer member are transferred onto the transfer material.

36. An image forming apparatus according to claim 24, further comprising a density detecting means for detecting density of the toner image on said image bearing member, after the toner image is formed on said image bearing member by said image forming means and before the toner image on said image bearing member is transferred onto said intermediate transfer member, and wherein said control means controls the voltage applied to said first charge member on the basis of a detected result from said density detecting means.

37. An image forming apparatus according to claim 36, wherein voltage obtained by overlapping DC voltage with AC voltage is applied to said first charge member.

38. An image forming apparatus according to claim 37, wherein said control means variably controls the DC voltage applied to said first charge member on the basis of a detected result from said density detecting means.

39. An image forming apparatus according to claim 36, wherein said image forming means includes an exposure device for forming an electrostatic latent image by exposing said image bearing member charged by said first charge member, and a developing device for developing the electrostatic latent image on said image bearing member.

40. An image forming apparatus according to claim 39, wherein said control means controls voltage applied to said developing device in accordance with the detected result from said density detecting means.

41. An image forming apparatus according to claim 36, wherein said image bearing member is capable of bearing plural color toner images to be successively transferred onto said intermediate transfer member in a superimposed fashion by said voltage apply means at said transfer position, and the plural color toner images on said intermediate transfer member are transferred onto the transfer material.

42. An image forming apparatus according to claim 24, wherein said first charge member has a roller.

43. An image forming apparatus according to claim 24, wherein said second charge member can engage with and disengage from said intermediate transfer member, and engages with said intermediate transfer member when the residual toner is charged.

44. An image forming apparatus according to claim 43, wherein said second charge member has a roller.

45. An image forming apparatus according to claim 24, wherein said detecting means detects said charge potential of the surface of said image bearing member after said first charge member charges said image bearing member and before said image forming means forms the toner image on said image bearing member.

46. An image forming apparatus according to claims 24, 27 or 37, wherein said voltage apply means applies a voltage of a polarity opposite to said normal polarity to a side opposite to a side onto which the toner image is transferred, of said intermediate transfer member.

* * * * *

UNITED STATES PATENT AND TRADEMARK OFFICE

CERTIFICATE OF CORRECTION

PATENT NO. : 6,049,681

DATED : April 11, 2000

INVENTOR(S): MOTOHIDE SHIOZAWA, ET AL.

It is certified that error appears in the above-identified patent and that said Letters Patent is hereby corrected as shown below:

COLUMN 3:
Line 40, "remaining" should read --remaining on--.

COLUMN 5:
Line 25, "ther-" should read --there- --;
Line 26, "ebetween." should read --between.--; and
Line 45, "photosensitve" should read --photosensitive--.

COLUMN 6:
Line 20, "generate" should read --generated--.

COLUMN 3:
Line 11, "or 3" should read --or 3,--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*